United States Patent [19]

Tanabe et al.

[11] Patent Number: 4,591,684

[45] Date of Patent: May 27, 1986

[54] COOKING COMPLETION DETECTION IN A COOKING APPLIANCE

[75] Inventors: Takeshi Tanabe, Higashiosaka; Kuniyoshi Fujikawa, Sakai; Takatoshi Yasuda, Yamatokoriyama; Nobuo Takeoka, Osaka, all of Japan

[73] Assignee: Sharp Kabushiki Kaisha, Osaka, Japan

[21] Appl. No.: 723,869

[22] Filed: Apr. 16, 1985

[51] Int. Cl.[4] ..... H05B 6/68

[52] U.S. Cl. ..... 219/10.55 B; 219/10.55 R; 99/325; 99/451

[58] Field of Search ..... 219/10.55 B, 10.55 R, 219/518; 99/325, 451, DIG. 14, 329 R, 328, 330

[56] References Cited

U.S. PATENT DOCUMENTS 4,255,639 3/1981 Kawabata ..... 219/10.55 B 4,463,238 7/1984 Tanabe ..... 219/10.55 B 4,481,394 11/1984 Tanabe ..... 219/10.55 B 4,521,658 6/1985 Wyland et al. ..... 219/10.55 B

*Primary Examiner*—Philip H. Leung

*Attorney, Agent, or Firm*—Birch, Stewart, Kolasch & Birch

[57] ABSTRACT

A cooking appliance in which food stored in a heating chamber is cooked by heating includes a detecting sensor for detecting completion of food to be cooked, a food weight measuring device for measuring weight of food to be cooked stored in the heating chamber, a detector for detecting a variation of the output of the detecting sensor, a comparison circuit for comparing the output of the detector with the output of the food weight measuring sensor, and a controller for controlling the heating operation depending upon on the output of the comparison circuit.

4 Claims, 5 Drawing Figures

COOKING COMPLETION DETECTION IN A COOKING APPLIANCE

BACKGROUND OF THE INVENTION

The present invention relates to a cooking appliance such as a microwave oven.

In the conventional microwave oven, completion of cooking is detected when that gas or moisture produced by cooked food in a heating chamber is detected by a detecting device when the surface temperature of the food to be cooked is detected by an infrared light detector, or when the temperature of exhaust air from the heating chamber is detected by a thermistor. When a predetermined condition such as the completion of food to be cooked is detected, the induction heating device is stopped.

In the conventional cooking techniques, if power is applied to a magnetron for producing a high frequency when food to be cooked is absent from the heating chamber, referred to as no-load condition, the gas or the moisture is not produced in the heating chamber. Accordingly, in the microwave oven in which the cooking completion of the food is judged by detecting the gas or the moisture from cooked food, the heating operation is continuously carried out. Further, a temperature of the heating chamber is locally and highly increased, so that use of the cooking appliance becomes dangerous.

In the microwave oven including an infrared light detecting device or a thermistor, when the food to be cooked is absent from the heating chamber, the heating operation is continuously carried out until the temperature in the heating chamber reaches a predetermined temperature. As the heating chamber is usually made of a metal material for reflecting microwaves, an increase of the temperature in the heating chamber is small as compared with the increase of the temperature of food which easily absorbs a high frequency signal and has a high dielectric constant. Accordingly, the heating period, even in the no-load condition, will continue for a long time.

Accordingly, that an improved cooking apparatus such as a microwave oven is disclosed, which can detect whether food to be cooked is present or absent in the heating chamber and enables a heating operation for a short period of time even when the food to be cooked is absent or just a small amount of the food to be cooked is present in the heating chamber.

SUMMARY OF THE INVENTION

Accordingly, it is an object of the present invention to provide an improved cooking appliance which can detect whether food to be cooked is present or absent in a heating chamber and enables a heating operation for a short period of time even when the food to be cooked is absent or just a small amount of the food to be cooked is present in the heating chamber.

It is another object of the present invention to provide an improved cooking appliance which can eliminate excess heating even when food to be cooked is absent or a small amount of the food to be cooked is present in a heating chamber.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above object, according to a preferred embodiment of the present invention, a cooking appliance in which food present in a heating chamber is cooked by a heating operation, comprises a scale for weighing the food, a detector for determining the completion of food as a function of changes in the physical characteristics of the food including a sensor for continuously measuring the physical characteristics and generating characteristic signals, the respective characteristic signals having levels representative of the degree of cooking achieved, a timer for sampling a characteristic signal generated by the sensor at the initiation of a cooking cycle and at a predetermined time following the initiation, a first comparator for comparing a characteristic signal at initiation with the characteristic signal at the predetermined time and determining when the difference between the levels of signals is greater or less than a predetermined value, the comparator generating a sensor enabled signal to the sensor when the difference is greater than the value and a comparator enable signal when the difference is less than the value, the sensor enable signal instructing the sensor to continue sensing changes in physical characteristics, a second comparator responsive to the comparator enable signal for comparing the weight of food determined by the scale with a predetermined weight, generating a power off signal when the weight is less than a predetermined weight and generating an instruction to the sensor to continue sensing the changes in physical conditions when the weight is greater than the predetermined weight, and a control responsive to either the power off signal from the second comparator, or the completion of cooking as determined by the detector means, terminating the cooking operation.

The operation of the heating means is stopped when the variation in the output of the cooking completion detection is less than a predetermined value and at the same time the weight of food measured by the weight measuring device is less than a predetermined weight.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
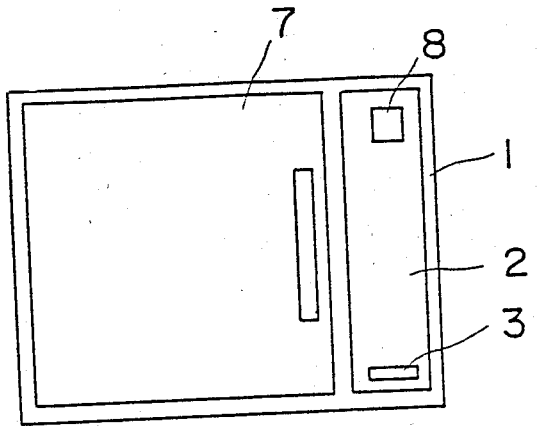
FIG. 1 shows a front view of a microwave oven in a preferred embodiment of the present invention.
Figure 2:
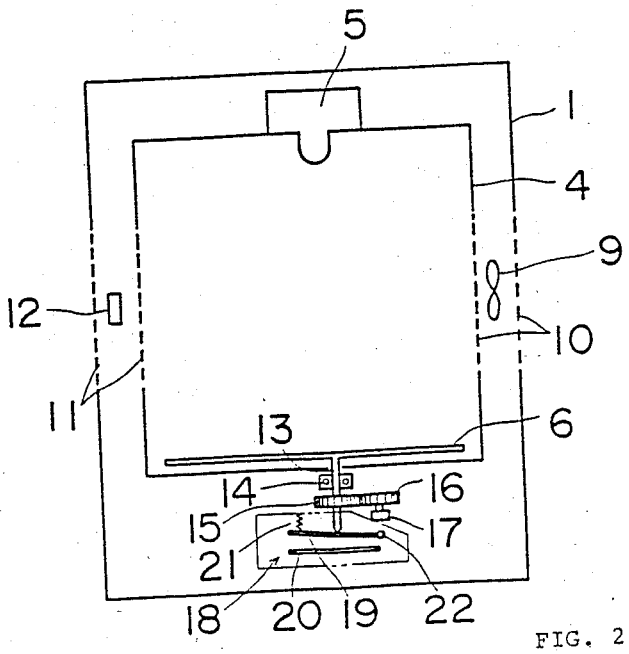
FIG. 2 shows a sectional view of the microwave oven in FIG. 1.

FIG. 1 shows a front view of a microwave oven according to a preferred embodiment of the present invention. FIG. 2 shows a sectional view of the microwave oven in FIG. 1. A heating chamber 4 is stored into a housing 1 of the microwave oven. An operation panel 2 having a heating key 3 is provided on a front wall of the housing 1 of a microwave oven. When the heating key 3 is depressed, a high frequency produced from a magnetron 5 is introduced into the heating chamber 4, and food to be cooked on a tray 6 is heated. A door 7 is pivotally provided on the front of the housing 1 to open or close the heating chamber 4. In the embodiment of the present invention, an "auto" heating key 8 is provided on the operation panel 2. When the "auto" heating key 8 is depressed, the magnetron 5 is driven to produce the high frequency.

When the heating key 3 is depressed after cooking information relating to a heating time or weight of food to be cooked or the like is manually introduced by input keys on the operation panel 2, the microwave heating starts. When only the "auto" heating key 8 is depressed, the cooking information relating to the heating time or the weight of food etc. is read out from a memory, and the microwave heating is carried out depending upon the introduced cooking information.

When the microwave heating is carried out, air is introduced into the heating chamber 4 from an air inlet 10 by driving a fan 9, and gases in the heating chamber 4 are exhausted from an exhaust outlet 11 to the outside.

A cooking completion detecting device 12 such as a sensor, which detects gas or moisture produced by heating the food, or which detects infrared light depending upon the surface temperature of cooked food, or which detectes the temperature of air exhausted air from the exhaust outlet 11, is provided adjacent the exhaust outlet 11.

A rotating axis 13 is provided at a substantially center portion of the bottom wall of the heating chamber 4, and is disposed in a vertical direction. One upper end of the rotating axis 13 is detachably connected to a substantial by center portion of a tray 6. The rotating axis 13 is rotatably supported by a bearing 14, and is inserted into a hole formed in a gear 15 so that the gear 15 is fixed to the rotating axis 13. A gear 16 is driven by a motor 17 which is in turn engaged with the gear 15. When the food is heated, the tray 6 rotates around the rotation axis 13, so that the rotating of the tray 6 prevents the temperature of cooked food from unevenly changing. The tray 6 may be moved up or down in the vertical direction of the rotating axis 13 in cooperation with the rotation of the tray 6.

Condenser 18 comprises a pivotable electrode plate 19 and a fixed electrode plate 20. One end of the pivotable electrode plate 19 is connected by a horizontal hinge pin 22, and the other end of the pivotable electrode plate 19 is connected to a spring 21 to pull the pivotable electrode plate 19 in an upward direction toward the tray 6 as shown in FIG. 2. The lower end of the rotating axis 13 is in contact with a substantial by center portion of the pivotable electrode plate 19. The pivotable electrode plate 19 is moved in the vertical direction around the horizontal hinge pin 22 depending upon the weight of food on the tray 6 against the power of the spring 21. Accordingly, an angle between the pivotable electrode plate 19 and the fixed electrode plate 20 changes depending upon the weight of the food, so that the capacitance of the condenser 18 is varied.

Figure 3:
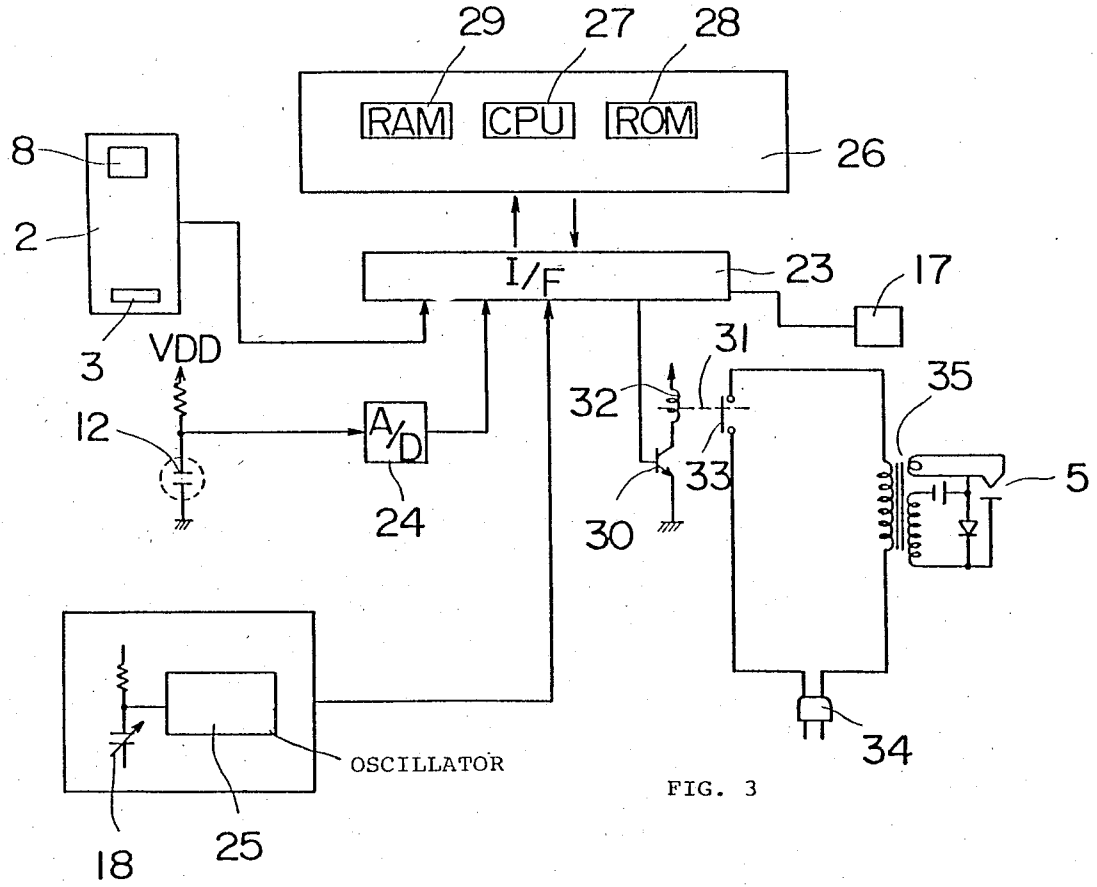
FIG. 3 shows a circuit diagram of the microwave oven in FIGS. 1 and 2.

FIG. 3 shows a circuit diagram of the microwave oven in FIGS. 1 and 2. When the heating key 3 or the "auto" heating key 8 provided at the operation panel 2 is depressed, such keyed signals are fed to an interface 23. An output from the cooking completion detecting device 12 is applied to the interface 23 through an analog/digital converter 24. The condenser 18 in which the capacitance varies depending upon the weight of food to be cooked on the tray 6, is connected to an oscillating circuit 25. When the capacitance of the condenser 18 changes based upon the weight of food on the tray 6, an oscillating frequency of the oscillating circuit 25 also changes. The output of the oscillating circuit 25 is fed to the interface 23. The interface 23 is connected to a processing circuit 26 such as a microprocessor. The processing circuit 26 includes a central processing unit (CPU) 27, a read only memory (ROM) 28 containing programs or the like, and a random access memory (RAM) 29 for arithmetic operations or the like. The output of the interface 23 is applied to a switching transistor 30 connected to a relay coil 32 in series. When the switching transistor 30 is electrically connected, the relay coil 32 is excited, thereby electrically connecting the relay switch 33. In this manner alternative power from a plug 34 is applied to a high power generating transformer 35 to thereby excite the magnetron 5. The output pulses of the oscillating circuit 25 are counted up by the processing circuit 26 over a constant period. Accordingly, the oscillating frequency of the oscillating circuit 25 is detected depending upon the pulse counting numbers.

Figure 4:
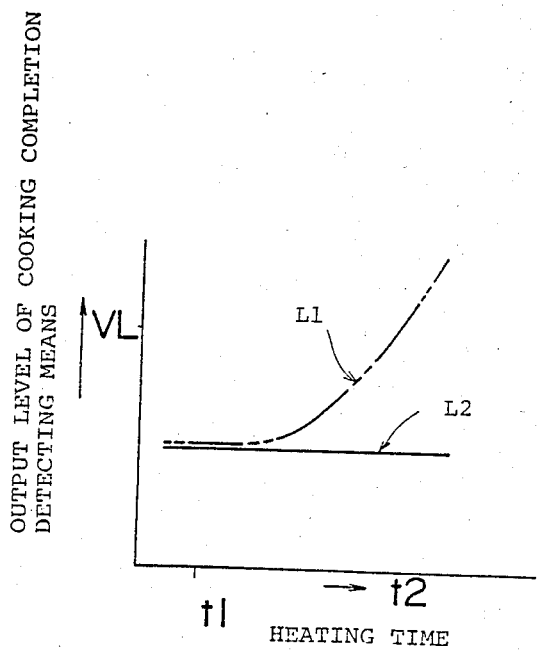
FIG. 4 shows a graph for explaining a time chart of an output level of a completion condition detecting device 12.

Referring to FIG. 4, the heating key 3 or the "auto" heating key 8 is depressed at a time $t_1$. According to the depression of the heating key, the motor 17 is driven, and the switching transistor 30 and the relay switch 33 are electrically connected to excite the magnetron 5. When the magnetron 5 is excited, the food disposed on the tray 6 in the heating chamber 4 begins to heat.

According to the heating, the output of the cooking completion detecting device 12 is increased as indicated by a line L1. When the output of the completion detecting device 12 arrives at the predetermined value VL at a time $t_2$, the processing circuit 26 is operated in a such manner that the switching transistor 30 and the relay switch 33 are cut off to stop the exciting of the magnetron 5 and the driving of the motor 17.

When the food to be cooked is not present in the heating chamber 4, and the heating key 3 or the "auto" heating key 8 is depressed, the motor 17 is driven and the magnetron 5 is excited, and then the heating is carried out. However, no gases or moisture is produced from the heating chamber 4, and the temperature in the heating chamber is not increased. Accordingly, the output of the completion detecting device 12 is less than the predetermined value VL for a long time, and is constant as indicated by a line $L_2$.

Figure 5:
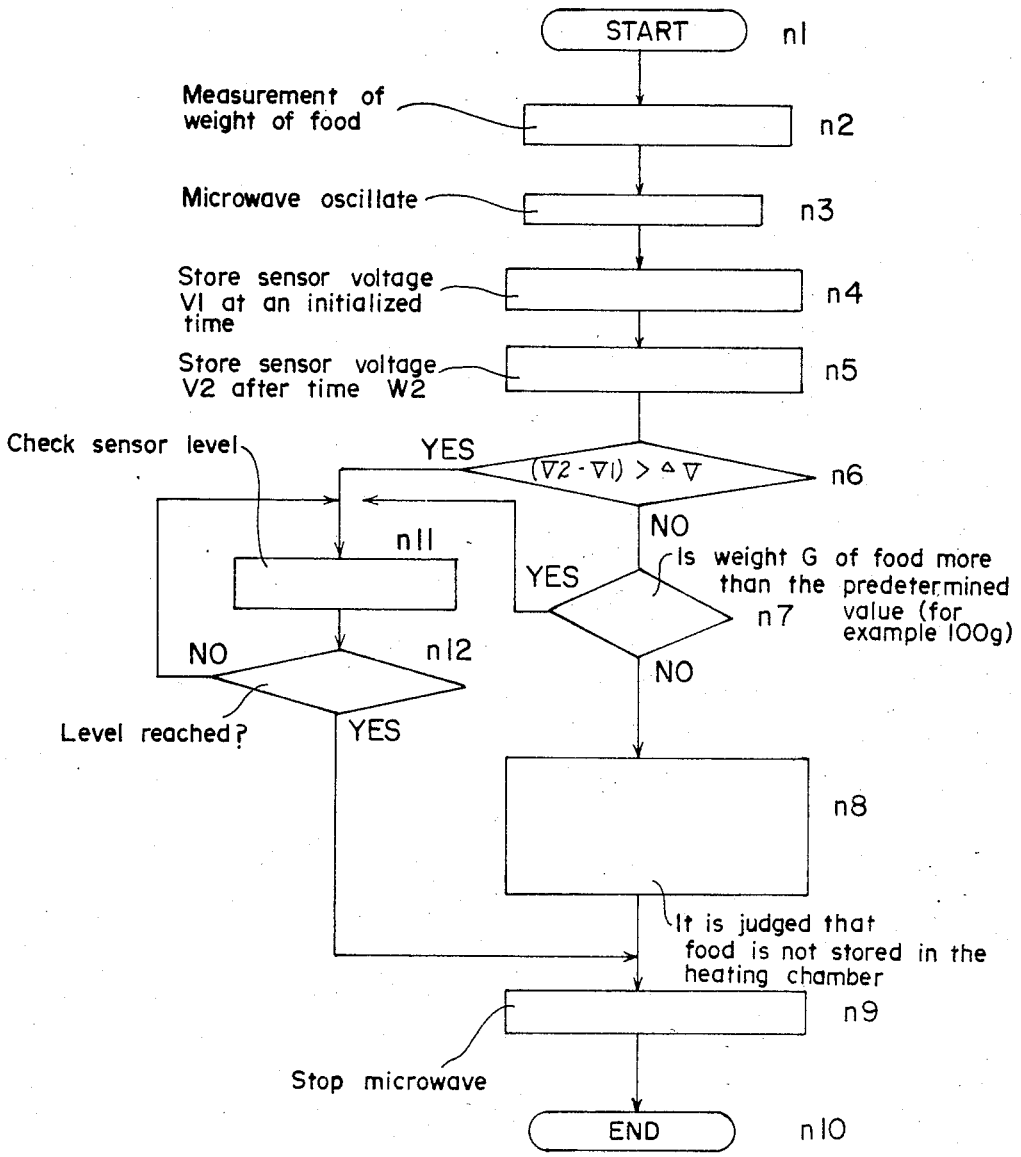
FIG. 5 shows a flowchart for explaining a heating operation of the microwave oven in the preferred embodiment of the present invention.

Conventionally, because the output level of the completion detecting device 12 is less than the predetermined value, the magnetron 5 is continuously excited. To resolve this problem, the present invention is provided. The operation of the microwave oven of the present invention will be described with reference to FIG. 5.

Step n1:

The heating key 3 or the "auto" heating key 8 is depressed to drive the motor 17 and to excite th magnetron 5.

Step n2:

The weight G of food to be cooked disposed on the tray 6 in the heating chamber 4 is measured in a such manner that the oscillating frequency of the oscillating circuit 25 corresponding to the capacitance of the condenser means 18 is detected by the operation of the processing circuit 26. The weight G is stored in an area of the random access memory 29.

Step n3:

The switching transistor 30 and the relay switch 33 are electrically connected to excite the magnetron 5, so that the high frequency waveform is applied to the heating chamber 4. The motor 17 is driven and then the tray 6 is rotated by the motor 17.

Step n4:

An output voltage $V_1$ of a cooking completion detecting device 12 when the heating operation is initiated is stored in an area of the random access memory 29. It may be evident that any other types of information from the cooking completion detecting device 12 can be selected.

Step n5:

When the heating is carried out over a predetermined period $W_2$ after starting the heating, the output voltage $V_2$ of the cooking completion detecting device 12 is stored in an area of the random access memory 29.

Step n6:

It is judged whether the difference between the first and second voltages $V_1$ and $V_2$ is more than a predetermined value $\Delta V$.

$$V_2 - V_1 > \Delta V \quad (1)$$

When the difference between the first and the second voltages $V_1$ and $V_2$ is equal to or less than the predetermined value $\Delta V$, step n7 is carried out.

Step n7:

It is judged whether the weight G of the good previously measured is more than a predetermined weight value, for example, about 100 g. If the weight G is equal to or less than the predetermined weight value, step n8 is carried out. The predetermined weight value can be changed according to the cooking appliance.

Step n8:

It is judged that no food is present on the tray 6 in the heating chamber 4.

Step n9:

The switching transistor 30 and the relay switch 33 are cut off to stop the exciting of the magnetron 5. Therefore, after generation of high frequency is stopped, step n10 is carried out, so that the heating operation is stopped.

As described above, when no food is present in the heating chamber 4, or just a small amount of the food to be cooked is present, the high frequency from the magnetron 5 is generated for a long time.

In step n6, when the formula (1) is satisfied, step n11 is carried out.

Step n11:

The output of the cooking completion detecting device 12 is always successively detected.

Step n12:

It is judged whether the voltage output from the cooking completion detecting device 12 is arrived at the predetermined voltage value VL. If the output voltage of the completion detecting device 12 is at the predetermined voltage value VL, step n9 is carried out to stop the operation of the magnetron 5. When the operation of the magnetron 5 is stopped, in step n10, the cooking of food is completed.

When the difference between the first and the second output voltages $V_1$ and $V_2$ is equal to or less than the predetermined $\Delta V$, there is a possibility that a large amount of food is wrapped by a wrap for preventing the generation of gases and moisture from cooked food may be stored in the heating chamber 4, or that refrigerated food may be present in the heating chamber. In this case, step n7 is executed to judge whether the food to be cooked is more than the predetermined weight value. If the weight of food is more than the predetermined weight value, even when the variation of the cooking completion detecting signal from the cooking completion detecting device 12 is low, the heating is continuously performed. In step n11, the voltage level is succesively detected, and then the operation is forwarded to step n12.

As described above, when no food is present in the heating chamber or just a small amount of the food is present in a heating chamber, unnecessary heating is not continued. Therefore, the microwave oven can be safely used.

Although the present invention is applied to the microwave oven, the present invention may be applied to various types of cooking appliances.

As described above, according to the present invention, even when no food is present in the heating chamber or a small amount of the food is present in the heating chamber, the cooking appliance enables a suitable heating operation without unnecessary heating. Therefore, accidents related to the unnecessary heating of the cooking appliance can be avoided and the cooking appliance can be safely used.

When no food is present in the heating chamber or a small amount of food is present in the heating chamber, the heating time of the heating operation can be reduced, for example, within about twenty minutes by detecting the cooking completion signal in cooperation with the measuring of the weight of food to be cooked.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A cooking appliance in which food placed in a heating chamber is cooked by a heating operation, comprising:

(a) scale means for weighing food;

(b) detector means for determining the completion of the cooking of said food as a function of changes in the physical characteristics of the food including sensor means for continuously measuring said physical characteristics and generating characteristic signals, the respective characteristic signals having levels representative of the degree of cooking achieved;

(c) timer means for sampling a characteristic signal generated by said sensor means at the initiation of a cooking cycle and at a predetermined time following said initiation;

(d) first comparator means for comparing the characteristic signal at initiation with the characteristic signal at said predetermined time and determining when the difference between the levels of said signals is greater or less than a predetermined value, said comparator means generating a sensor enable signal to said sensor means when said difference is greater than said value on a comparator enable signal when said difference is less than said value, said sensor enable signal instructing said sensor means to continue sensing said changes in said physical characteristics;

(e) second comparator means responsive to said comparator enable signal for comparing the weight of food determined by said scale means with a predetermined weight, generating a power OFF signal when said weight is less than said predetermined weight or generating an instruction to said sensor means to continue sensing said changes in physical condition when said weight is greater than said predetermined weight; and (f) control means responsive to either said power OFF signal from said second comparator means, or the completion of cooking as determined by said detector means, for terminating the cooking operation.

2. The cooking appliance according to claim 1, wherein said sensor means is an infrared light detector which senses the surface temperature of said food.

3. The cooking appliance according to claim 1, wherein said sensor means is a thermistor which detects the temperature of gas exhausted from the appliance.

4. The cooking appliance according to claim 1, wherein said sensor means detects the amount of moisture given off by said food.

* * * * *